US006918848B2

(12) United States Patent
Kuhn

(10) Patent No.: US 6,918,848 B2
(45) **Date of Patent: *Jul. 19, 2005**

(54) FLEXIBLE BROADHEAD ARROW

(76) Inventor: Todd A. Kuhn, 171 Springfield Dr. S., North East, MD (US) 21901

( * ) Notice: Subject to any disclaimer, the term of this patent is extended or adjusted under 35 U.S.C. 154(b) by 0 days.

This patent is subject to a terminal disclaimer.

(21) Appl. No.: 10/684,197

(22) Filed: Oct. 14, 2003

(65) Prior Publication Data

US 2004/0074483 A1 Apr. 22, 2004

Related U.S. Application Data

(62) Division of application No. 10/178,243, filed on Jun. 25, 2002, now Pat. No. 6,663,518.

(51) Int. Cl.[7] ..... F42B 6/08
(52) U.S. Cl. ..... 473/583
(58) Field of Search ..... 473/583, 584

(56) References Cited

U.S. PATENT DOCUMENTS 3,672,677 A * 6/1972 Moore ..... 473/578
3,897,062 A * 7/1975 Christensen ..... 473/583
4,012,043 A * 3/1977 Carella ..... 473/586
4,392,654 A * 7/1983 Carella ..... 473/586
4,534,568 A * 8/1985 Tone ..... 473/583
4,565,377 A * 1/1986 Troncoso et al. ..... 473/584
4,986,550 A * 1/1991 Segovia ..... 473/584
5,064,202 A * 11/1991 Barner ..... 473/583
5,257,809 A * 11/1993 Carrizosa ..... 473/584
5,613,688 A * 3/1997 Carella ..... 473/586
5,897,449 A * 4/1999 Roberts et al. ..... 473/586
6,142,896 A * 11/2000 Simo et al. ..... 473/586
6,319,161 B1 * 11/2001 Martinez et al. ..... 473/583

* cited by examiner

*Primary Examiner*—John A. Ricci

(57) ABSTRACT

The invention is a broadhead arrowhead. The broadhead arrowhead includes a ferrule, one end portion of which is tapered to a substantial point. One or more blade assemblies extend outwardly from the ferrule. Each blade assembly has a first substantially planar main surface portion disposed in a plane at least substantially parallel to a longitudinal axis of the ferrule and a second surface portion having a planar region offset at an angle to the plane of the main surface portion. A generally continuously curved region is disposed between and connecting the first and second portions, such that the blade assembly has an airfoil-type shape. Only the first planar portion of the blade assembly is coupled to the ferrule thereby allowing the second portion to flex during penetration of a target and achieve greater penetration depth.

26 Claims, 4 Drawing Sheets

FLEXIBLE BROADHEAD ARROW

RELATED APPLICATIONS

The present invention is a continuation-in-part of previous U.S. patent application Ser. No. 10/178,243 by the same inventor filed Jun. 25, 2002 now U.S. Pat. No. 6,663,518 which is incorporated herein by reference.

BACKGROUND OF THE INVENTION

1. Field of the Invention

The present invention relates to the field of archery. Specifically, the invention relates broadhead arrowheads found on arrow devices.

2. Description of the Prior Art

Bowhunting and archery rely on arrows to achieve penetration of the intended target regardless of whether that intended target is a static bulls-eye or a hunted animal. The problem of target penetration has been addressed in several ways. For hunters, target penetration can be directly correlated to the likelihood of hunting success: an arrow that can not adequately penetrate an intended animal is of little use to a hunter. The overall mass of the arrow could be increased, but more massive arrows are clumsy and must be fired in a high arc to reach the intended target. Simple "field point" arrow tips can provide adequate penetration for straw targets in competition, but they are not very effective for harvesting hunted animals. Prior art broadhead arrows were invented to increase effective hunting penetration and success potential. Typically two to four flat, triangular blades are arranged around the forward pointed tip. As the tip enters the intended target, the blades slice a region much greater than the diameter of the arrow shaft.

Unfortunately, these broad, flat blades have a pronounced aerodynamic effect that can radically affect the overall stability of the arrow in flight and significantly reduce the precision of flight. Since the majority of hunting tips are broadhead in design, the combined effect of broadhead and fletching and/or vanes at opposite ends of an arrow may not promote a stable flight.

SUMMARY OF THE INVENTION

The present invention is a continuation in part of previous U.S. patent application Ser. No. 10/178,243 by the same inventor filed Jun. 25, 2002. Application Ser. No. 10/178,243 describes a broadhead arrowhead system wherein a plurality of blades, each including an airfoil design, provides excellent rotation of the arrow shaft during flight without producing a large amount of aerodynamic drag.

A key feature of the present invention is the design of the airfoil blades, wherein the trailing portion of each blade is attached only to the leading portion of each blade and not to the main body or ferrule. When fired into a target, this design enables the flexible blade to collapse as it enters the target such that the leading and trailing portions of each blade are substantially coplanar during penetration. This flexing enables greater penetration than would be available with a rigid airfoil blade design. The invention is compatible with all contemporary arrow shafts.

DETAILED DESCRIPTION OF THE INVENTION

Figure 1:
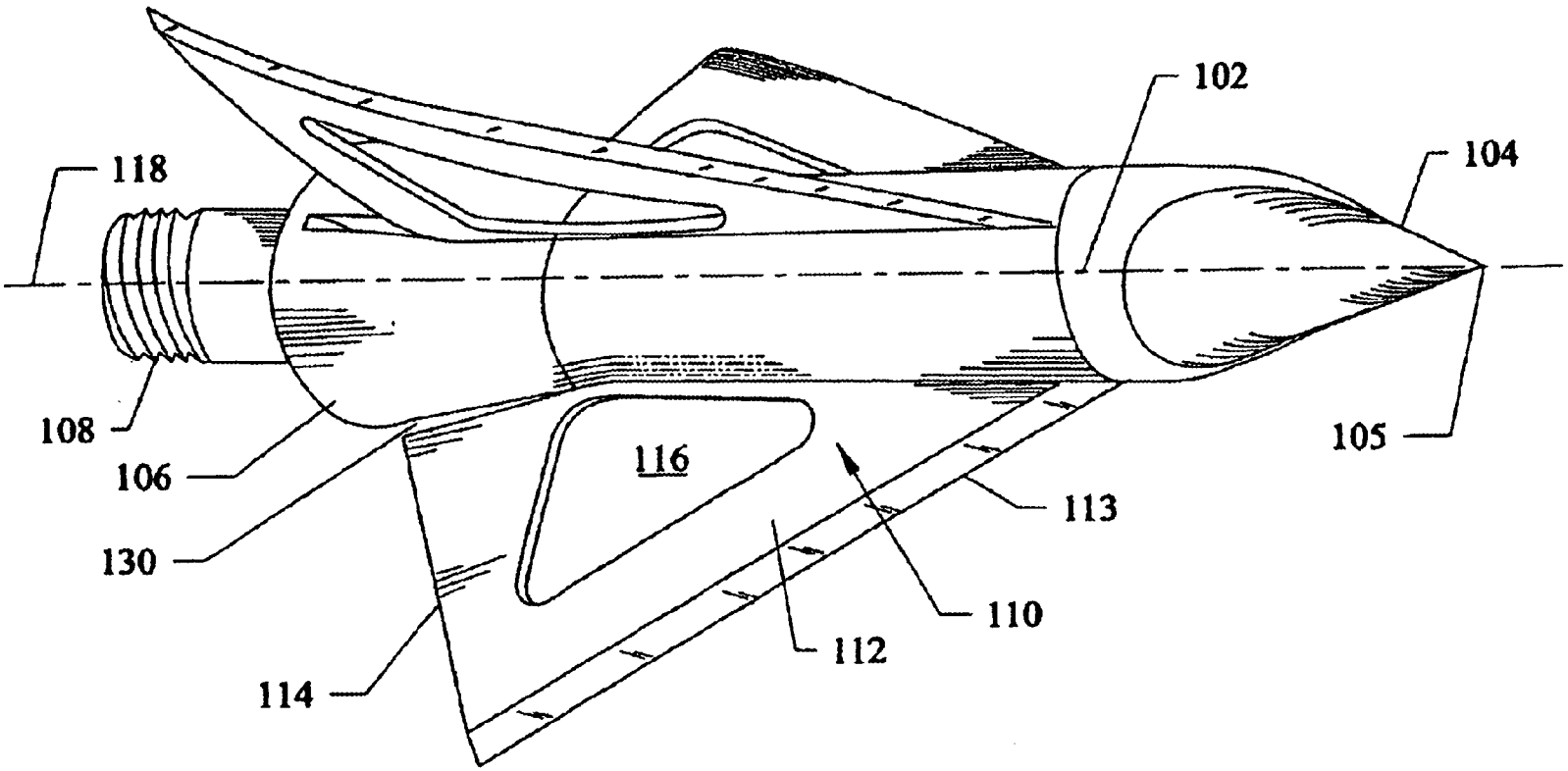
FIG. 1 shows a side perspective of the broadhead arrowhead of the present invention.

The present invention is a continuation in part of previous application Ser. No. 10/178,243 by the same inventor. The content of the previous application is incorporated by reference and recited herein.

With reference to FIGS. 1 through 5, the broadhead arrowhead of this invention comprises a body or ferrule 102. At a first, or proximal, end, ferrule 102 incorporates a first end portion 104. First end portion 104 typically tapers to a point 105. Ferrule 102 also has a second, or distal, end portion 106. Second end portion 106 may be slightly flared outwardly. It is not necessary that second end portion 106 be flared outwardly, however. In some embodiments, second end portion 106 may continue substantially straight to the rear end of body 102. Ferrule 102 is typically symmetrical about a longitudinal axis 118 between first end portion 104 and second end portion 106.

A mounting stub 108 extends rearwardly from second end portion 106 of arrowhead body 102. Typically, stub 108 is symmetrical about and coaxial with longitudinal axis 118. Mounting stub 108 is intended to fit into a mating recess typically located at one end of a standard arrow shaft. Stub 108 may be threaded to mate with matching threads in the arrow shaft recess or it may be seated in the recess in a press fit arrangement. Alternatively, mounting stub 108 may be glued or otherwise sealed into the mating recess of the arrow shaft.

In other variations of mounting means, instead of a stub 108, second end 106 of body 102 may be hollowed out to fit over an arrow shaft. In such an arrangement, the inside of hollow second end 106 may be threaded to mate with threads on the outer surface of the arrow shaft; or distal second end 106 may be press fit over the arrow shaft. Alternatively, second end 106 may be fitted over the end of the arrow shaft and glued or otherwise sealed to the arrow shaft.

One or more blade assemblies 110 extend laterally outwardly from ferrule 102. Preferably the arrowhead is constructed with two, three, or four blade assemblies. Typically, if two blade assemblies are used, they are disposed substantially diametrically opposite each other about longitudinal axis 118 of ferrule 102. Three blade assemblies are typically disposed at angles of approximately 120° around longitudinal axis 118. Correspondingly, four blade assemblies 110 are typically mounted at 90° angles relative to each other about horizontal axis 118.

Figure 4A:
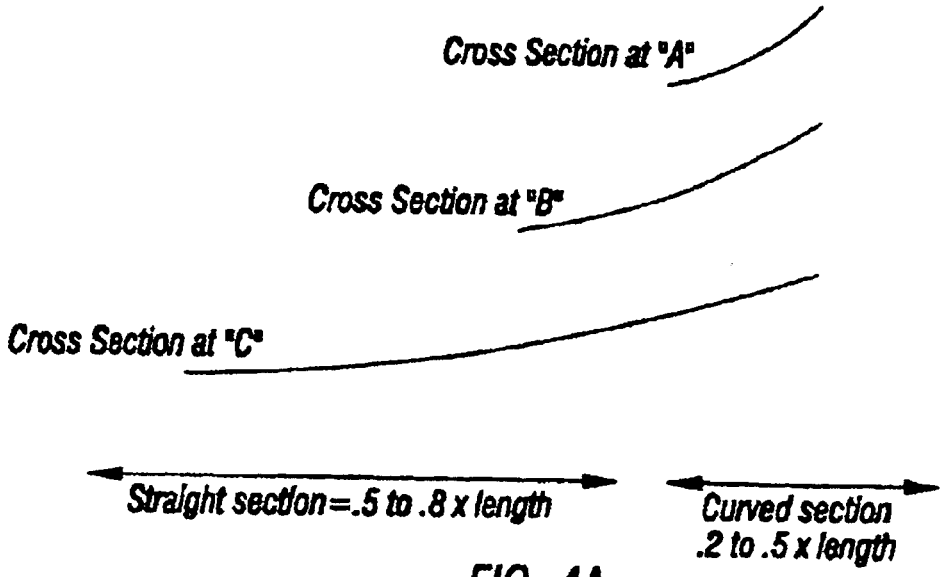
FIG. 4A shows the curvature of the blade assembly at three sections taken along section lines "A—A", "B—B", "C—C", respectively, in FIG. 4.
Figure 4:
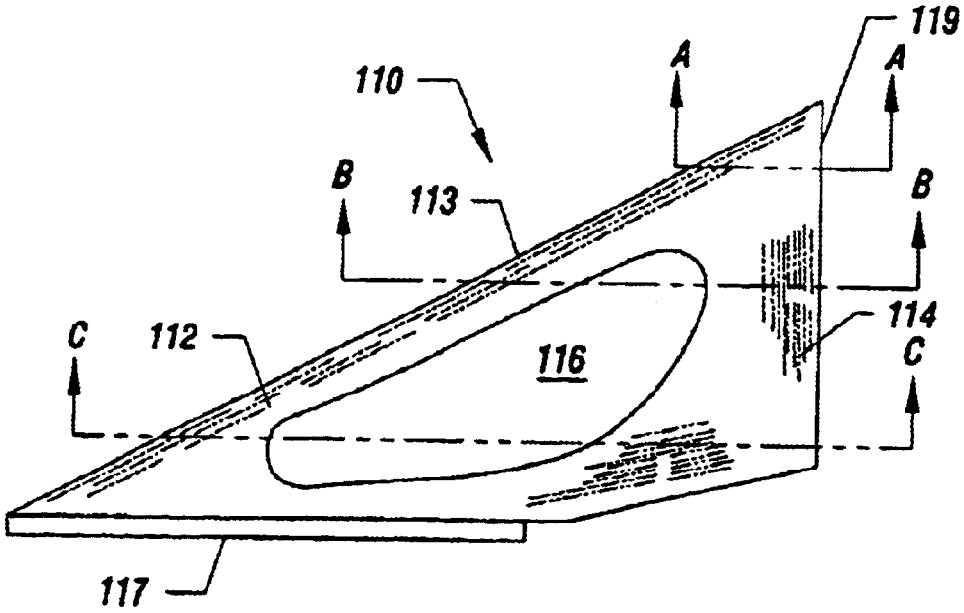
FIG. 4 shows a detailed view of one of the blade assemblies of the arrowhead.

Blade assembly 110 is shown in detail in FIGS. 1 and 4. Each blade assembly 110 comprises a first substantially planar blade assembly portion 112 and a second substantially blade assembly portion 114. A leading edge 113 of first portion 112 is typically sharpened to better allow the arrowhead to penetrate a target. First blade assembly portion 112 may comprise a solid substantially flat planar portion or optionally may have a cutout section 116. Second blade assembly portion 114 extends rearwardly from first blade assembly portion 112 at an angle thereto. Second blade assembly portion 114 is preferably curved, with a radius of curvature optimally between about 0.2" and 0.5", giving the blade the characteristics of an airfoil. The radius of curvature may vary over the surface of the blade. A trailing edge 119 of the blade is at an angle to arrowhead body 102. This angle may be as great as 45 degrees or more, but optimally it increases from approximately 5 degrees to approximately 35 degrees at the blade tip. The blades, acting together, form an axial-flow turbine.

Figure 3:
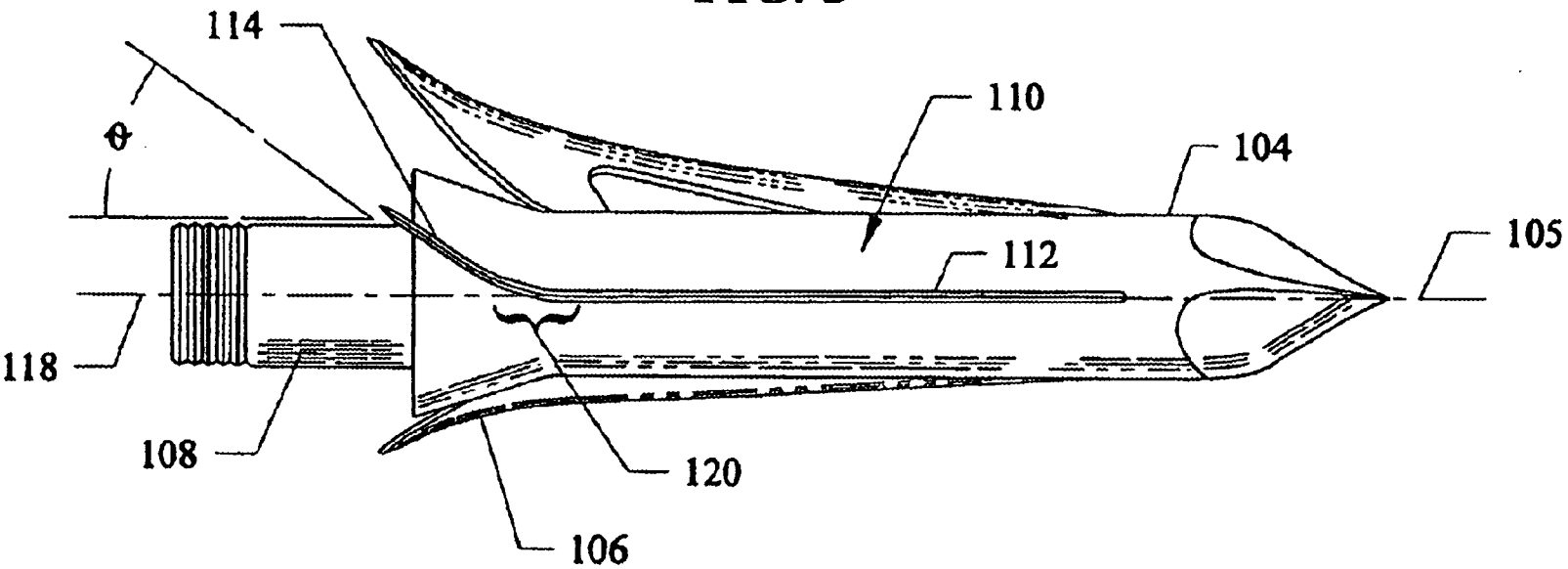
FIG. 3 shows a side detail view of the broadhead arrowhead.

As shown in FIG. 3, second blade assembly portion 114 is joined to first blade assembly portion 112 by a continuously curved region 120. The radius of curvature of region 120 is in the range of between about 0.2" and 0.5". An angle θ generally defines the angle between first planar portion 112 and second planar portion 114. This angle θ is in the range of between about 5 degrees and 25 degrees. This configuration gives the blade assembly an airfoil-type shape. The length of first substantially planar portion 112 is between about 50% and 80% of the total length of blade assembly 110. Correspondingly, second substantially planar portion 114 comprises between about 20% and 50% of the total length of blade assembly 110. It will be understood by those skilled in the art that where the arrowhead has more than one blade assembly 110, each second blade assembly portion 114 is preferably angled relative to each corresponding first blade assembly portion 112 in the same direction and at substantially the same angle for each blade assembly 110.

Alternatively, first planar portion 112 and second angled portion 114 may be joined at a more sharply defined angle θ with a radius of curvature close to or at "0". However, this alternative configuration does not produce the same high quality of aerodynamic effects as does the airfoil shape shown in FIG. 3.

FIG. 4A shows the curvature of the blade assembly 110 at three sections taken along section lines "A—A", "B—B", "C—C", respectively, in FIG. 4.

Arrowhead body 102 and blade assemblies 110 may be made of any suitable material, such as, but not limited to, steel, aluminum, plastic, etc. As shown in FIG. 4, first planar portion 112 of blade assembly 110 has a short extension 117 that fits into a slotted opening in body 102. Extension 117 extends from the inner edge of first planar portion 112 substantially up to but just short of curved region 120. Extension 117 may be glued, welded or soldered into the slot of body 102. Alternatively, blade assembly 110 and body 102 may be integrally formed as by molding. Other techniques for securing blade assembly 110 to body 102 would be apparent to those skilled in the relevant arts.

Figure 2:
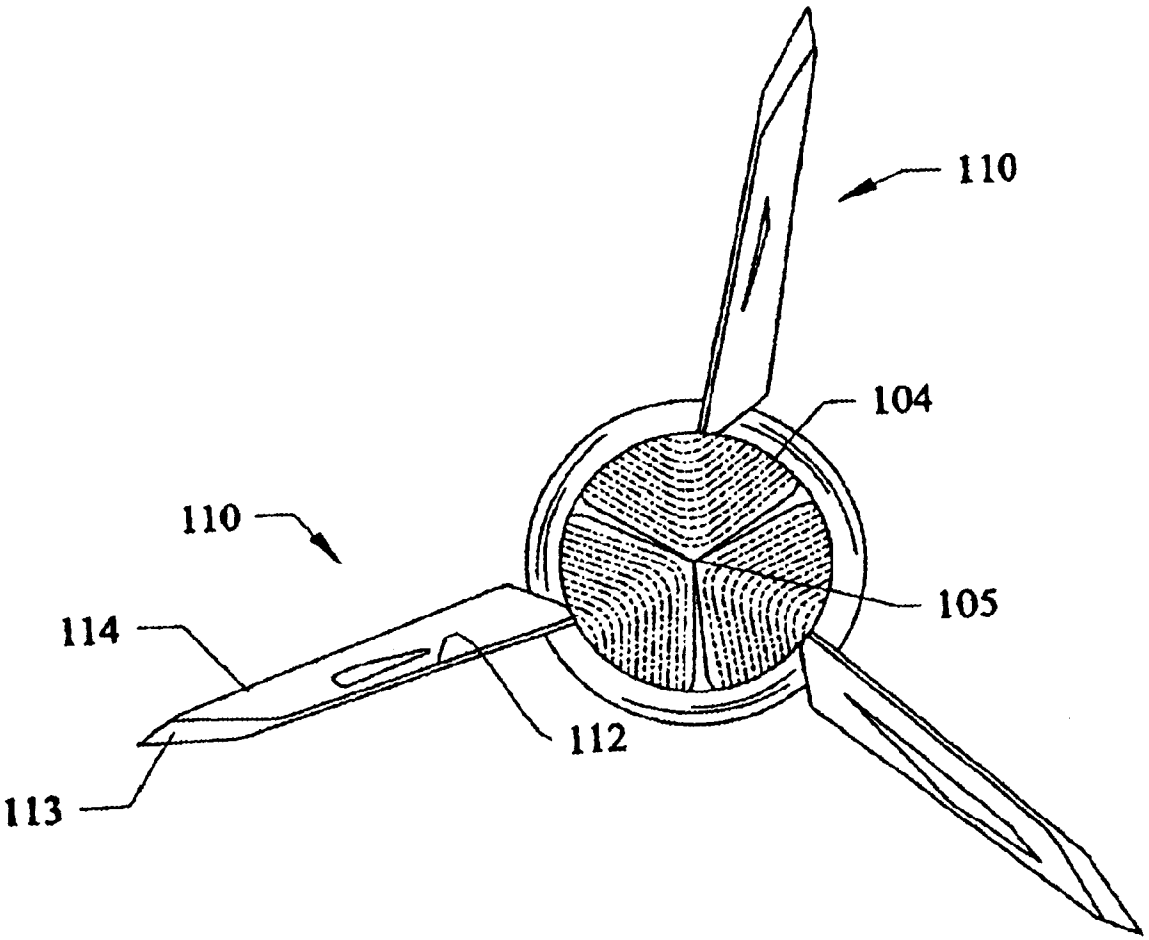
FIG. 2 shows a front-end view of the broadhead arrowhead looking rearwardly from the forward end of the arrowhead.

In summary, each blade assembly 110 comprises a substantially flat first planar portion 112 extending laterally outwardly from body 102 and substantially parallel to longitudinal axis 118. A second blade assembly portion 114 is angled at an angle of between about 5° and 25° out of the plane of first planar portion 112 away from alignment with axis 118 and at an angle of between about 5° and about 45° to the ferrule body 102. FIG. 2 shows second end portions 114 of each blade angles slightly clockwise relative to the major plane of first planar portion 112. Alternatively, second end portions 114 can be angled slightly counterclockwise relative to the major plane of first planar portions 112.

In the embodiment shown, each blade assembly 110 has the general shape of a substantially triangular or delta wing configuration. In other embodiments, blade assembly 110 can have the general shape of a swept wing or a straight wing.

Much like the control surfaces of an aircraft wing, the ratio of angled portion length to overall blade assembly length can be relatively small. For example, in one embodiment, the ratio of the length of angled second portion 114 to the overall length of blade assembly 110 is in the range of between 10% and 50%, and preferably between about 20% and 50%.

Each blade of the broadhead arrowhead incorporates a substantially similar airfoil that produces a rotational torque about longitudinal axis 118. In flight, these forces induce a rapid rotation of the arrow about longitudinal axis 118 while minimizing aerodynamic drag. The plane of each blade assembly 110 remains parallel to the shaft of the arrow along its cutting edge 113.

Figure 5:
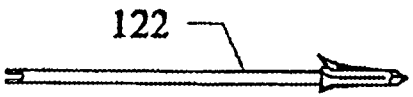
FIG. 5 shows the broadhead arrowhead mounted to an arrow shaft.

One of the features of the arrowhead of this invention is its ability to produce stabilized arrow flight without the use of fletching or tail fins (or feathers). FIG. 5 shows the broadhead arrowhead of this invention mounted to an arrow shaft 122 without fletching. Tests have shown that an arrow using the broadhead of this invention without fletching tracks true in flight and does not deviate significantly from the planned flight course. This is due to the rotation induced in the arrow by the aerodynamically designed broadhead blades, which is sufficient to stabilize the arrow in flight. Eliminating or reducing the size of the fletching in fact improves flight characteristics because the rotational drag normally induced by the fletching is avoided. It should be noted, however, that the arrowhead of the invention can be used with fletched arrow shafts as well.

A key feature of the present invention is the ability of curved region 120 and second planar portion 114 to flex during penetration due in part to the fact that second planar portion 114 and continuously curved region 120 are only integral with first planar portion 112 and not directly integral with body 102. In the preferred embodiment there is in fact a slight gap 130 between the combination of second planar portion 114 plus curved region 120 and body 102 as shown in FIG. 1. Being manufactured from rigid yet flexible material, such as stainless steel, the blade assemblies 110 of the present invention retain their airfoil shape during release and flight. Aerodynamic forces exerted on blade assemblies 110 during flight are not sufficient to flex second planar portion 114 nor to change angle θ. During impact, first planar portion 112 enters perpendicular to the target as with any conventional broadhead. As the arrow decelerates, the flexible blade of the present invention collapses such that the angle θ approaches zero degrees as a result of physical contact pressure on the top and bottom surfaces of blade assemblies 110 exerted by the penetrated target. Thus as the arrow decelerates completely, first planar portion 112 and second planar portion 114 become substantially coplanar. This flexing enables greater penetration than would be possible if second planar portion 114 was held in a completely rigid airfoil geometry by attachment to both first planar portion 112 and to body 102. Such an inflexible broadhead must corkscrew into the target wasting kinetic energy and inhibiting complete penetration of the arrowhead.

An additional benefit of the flexible blade assemblies 110 of the present invention is an increased probability that the arrow will remain buried in the target. Attempts to remove the arrow relieve the physical pressure on flattened second planar portion 114 thereby enabling it to spring back to its airfoil shape, due to the shape memory of materials such as stainless steel, and inhibit backing out through the same entry path. An arrow that remains buried in a hunted animal debilitates more than just the entry wound itself. In order to forcefully remove the arrowhead of the present invention, an animal would greatly expand the extent of the wound and only further increase the probability of its own demise.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A broadhead arrowhead comprising:

a ferrule;

at least one blade assembly coupled to and extending outwardly from said ferrule;

said blade assembly having a first substantially planar portion disposed in a plane at least substantially parallel to the longitudinal axis of said ferrule and a second portion wherein said second portion is disposed at an angle to the plane of said first planar portion and said second portion is also disposed at an angle to the longitudinal axis of said ferrule;

a generally continuously curved region disposed between and connecting said first and second portions, wherein said blade assembly has an airfoil-type shape that produces a rotational torque about the longitudinal axis of said ferrule; and wherein said first portion couples said blade to said ferrule.

2. An arrowhead according to claim 1, further comprising a plurality of said blade assemblies disposed substantially symmetrically around the longitudinal axis of said ferrule.

3. An arrowhead according to claim 2, wherein said blade assemblies are manufactured from a flexible material.

4. An arrowhead according to claim 3, further comprising at least three blade assemblies disposed substantially symmetrically around the longitudinal axis of said ferrule spaced at angles of approximately 124° from each other.

5. An arrowhead according to claim 3, further comprising means for mounting said arrowhead to an arrow shaft.

6. An arrowhead according to claim 5, wherein said arrowhead mounting means comprises a stub member extending from one end of said ferrule substantially coaxial with the longitudinal axis of said ferrule.

7. An arrowhead according to claim 4, wherein one end portion of said ferrule is tapered substantially to a point.

8. An arrowhead according to claim 3, wherein said second portion is disposed at an angle of between about 5° and about 25° relative to the plane of said first substantially planar portion.

9. An arrowhead according to claim 3, wherein said second portion has a length of between about 20% and about 50% of the overall length of said blade assembly.

10. An arrowhead according to claim 3, wherein said continuously curved region has a radius of curvature between about 0.2" and 0.5".

11. An arrowhead according to claim 3, wherein said second portion has a trailing edge region disposed at an angle to said ferrule.

12. An arrowhead according to claim 11, wherein said trailing edge region is disposed at an angle to said ferrule in the range of about 5 degrees and about 45 degrees.

13. An arrowhead according to claim 12, wherein said trailing edge region is disposed at an angle to said ferrule in the range of about 5 degrees and about 35 degrees.

14. A broadhead arrow, comprising:

a ferrule;

at least one blade assembly coupled to and extending outwardly from said ferrule;

said blade assembly having a first substantially planar portion disposed in a plane at least substantially parallel to the longitudinal axis of said ferrule and a second portion wherein said second portion is disposed at an angle to the plane of said first planar portion and said second portion is also disposed at an angle to the longitudinal axis of said ferrule;

a generally continuously curved region disposed between and connecting said first and second portions, wherein said blade assembly has an airfoil-type shape;

wherein said first substantially planar portion couples said blade to said ferrule; and a shaft devoid of fletching, said arrowhead being secured to one end region of said shaft.

15. An arrow according to claim 14, further comprising a plurality of said blade assemblies disposed substantially symmetrically around the longitudinal axis of said ferrule.

16. An arrow according to claim 15, wherein said blade assemblies are manufactured from a flexible material.

17. An arrow according to claim 16, further comprising at least three blade assemblies disposed substantially symmetrically around the longitudinal axis of said ferrule spaced at angles of approximately 120° from each other.

18. An arrow according to claim 17, wherein one end portion of said ferrule is tapered substantially to a point.

19. An arrow according to claim 16, further comprising means for mounting said arrowhead to an arrow shaft.

20. An arrow according to claim 19, wherein said arrowhead mounting means comprises a stub member extending from one end of said ferrule substantially coaxial with the longitudinal axis of said ferrule.

21. An arrow according to claim 16, wherein said second portion is disposed at an angle of between about 5° and about 25° relative to the plane of said first substantially planar portion.

22. An arrow according to claim 16, wherein said second portion has a length of between about 20% and about 50% of the overall length of said blade assembly.

23. An arrow according to claim 16, wherein said continuously curved region has a radius of curvature between about 0.2" and 0.5".

24. An arrow according to claim 16, wherein said second portion has a trailing edge region disposed at an angle to said ferrule.

25. An arrow according to claim 24, wherein said trailing edge region is disposed at an angle to said ferrule in the range of about 5 degrees and about 45 degrees.

26. An arrow according to claim 25, wherein said trailing edge region is disposed at an angle to said ferrule in the range of about 5 degrees and about 35 degrees.

* * * * *